US008375474B2

(12) United States Patent
Arai

(10) Patent No.: US 8,375,474 B2
(45) Date of Patent: Feb. 19, 2013

(54) SHIELD LOCKING MECHANISM FOR HELMET

(76) Inventor: Michio Arai, Saitama-Ken (JP)

( * ) Notice: Subject to any disclaimer, the term of this patent is extended or adjusted under 35 U.S.C. 154(b) by 823 days.

(21) Appl. No.: 11/714,879

(22) Filed: Mar. 7, 2007

(65) Prior Publication Data

US 2008/0141443 A1 Jun. 19, 2008

(30) Foreign Application Priority Data

Dec. 14, 2006 (JP) ..... 2006-336940

(51) Int. Cl.
*A42B 1/08* (2006.01)
*A42B 1/00* (2006.01)
*A63B 71/10* (2006.01)

(52) U.S. Cl. ..... 2/424; 2/425; 2/9

(58) Field of Classification Search ..... 2/410, 6.1, 2/6.2, 6.3, 6.4, 6.5, 6.6, 6.7, 6.8, 421, 422, 2/423, 424, 425, 15, 13, 426, 427, 428, 429, 2/430, 431, 432, 433, 434, 435, 436, 441, 2/443; D29/102, 103, 104, 105, 106, 107, D29/108, 109, 110

See application file for complete search history.

(56) References Cited

U.S. PATENT DOCUMENTS

| | | | | |
|---|---|---|---|---|
| 4,807,305 | A | 2/1989 | Sundahl | |
| 4,907,300 | A | 3/1990 | Dampney et al. | |
| 5,058,212 | A * | 10/1991 | Kamata | 2/424 |
| 5,165,117 | A * | 11/1992 | Kamata | 2/424 |
| 5,182,816 | A * | 2/1993 | Arai | 2/424 |
| 5,185,889 | A * | 2/1993 | Kamata | 2/424 |
| 5,553,329 | A * | 9/1996 | Casartelli | 2/424 |
| 6,301,721 | B1 * | 10/2001 | Arai | 2/424 |
| 6,654,969 | B2 * | 12/2003 | Taniuchi | 2/424 |

FOREIGN PATENT DOCUMENTS

| | | | |
|---|---|---|---|
| EP | 502272 | A1 * | 9/1992 |
| EP | 1856999 | A2 * | 11/2007 |

* cited by examiner

*Primary Examiner* — Shelley Self
*Assistant Examiner* — Jane Yoon
(74) *Attorney, Agent, or Firm* — Dykema Gossett PLLC

(57) ABSTRACT

A locking mechanism for a helmet with a rotatable face shield includes an operating element that, when the shield is in a fully closed position, holds the shield from the outside against the outer wall of the helmet main body, and to open the shield, spreads out the shield and disengages a projection from a fitting portion.

4 Claims, 8 Drawing Sheets

SHIELD LOCKING MECHANISM FOR HELMET

BACKGROUND OF THE INVENTION

1. Field of the Invention

The present invention relates to a locking mechanism that maintains a fully closed position for a helmet shield.

2. Description of the Related Art

A known locking mechanism for maintaining a fully closed position for a helmet shield is arranged so that a through hole is formed as a fitting portion in the lower edge of the shield, while a projection to be fitted into the fitting portion is formed on the face of a helmet main body, and is opposite the fitting portion in the shield when the shield is fully closed. Thus, the projection is fitted into the fitting portion in the fully closed shield position, so that the fully closed position is maintained.

And to open the shield, while maintained in the fully closed position, a helmeted person spreads the shield outward in the vicinity of the locking mechanism for the shield to disengage the projection from the fitting portion, and pivots the shield upward while maintaining this unlocked position.

That is, in the position wherein the fully closed shield position is maintained, the locking mechanism of the shield inhibits upward pivoting of the shield, which is the normal opening movement, and because of this pivoting inhibition, ensures the fully closed shield position.

SUMMARY OF THE INVENTION

With prior art helmet shields the fully closed position of a shield can be steadily maintained; however, the operation for engaging and disengaging a projection from a fitting portion should be even further simplified, and one objective of the present invention is to provide a locking mechanism for a helmet shield that resolves this problem.

Further, in addition to the above problem, with prior art helmet shields the fully closed position of the shield must be more securely maintained, and a phenomenon whereby a lock is unexpectedly released by the deflection of the shield due to shock during an accident must be overcome, and the objective of the invention is to provide a locking mechanism for a helmet shield that resolves this problem.

In order to achieve the above objectives, technical means adopted by the present invention is a locking mechanism, for a shield of a helmet, that maintains a fully closed shield position, which is vertically pivoted to open or close a front opening of a main body of the helmet, formed in order to ensure a field of vision for a helmeted person, and that maintains the fully closed shield position by engaging a projection which is formed either on a lower end portion of the shield or on the side of a helmet main body, which is opposite the lower end portion of the shield in the fully closed position, and a fitting portion formed on the other side, and that spreads the shield outward to disengage the projection from the fitting portion, characterized in that:

the locking mechanism is so arranged that an operating element, which includes a sloping face portion, for releasing an engaged position of the fitting portion and the projection, and a pressing piece, for maintaining the engaged position, is located on a helmet main body side;

the operating element is supported at a position, on either side, along a rotational center of the operating element, so as to pivot alternately in directions in which the operating element is brought near and separated from the lower end portion of the shield;

as the sloping face portion is pivoted in a direction in which the sloping face portion is brought near the lower end portion of the shield, the pressing piece is rotated in a direction for separation from the lower end portion of the shield and removes limitations restricting spreading of the shield; and at the same time, as the sloping face portion is rotated in said direction, the sloping face portion is guided, from the lower end portion of the shield, and is inserted into the shield and the outer face of the helmet main body, so that the shield is spread outward, following the slope of the sloping face portion.

Further, a locking mechanism, for a shield of a helmet, that maintains a fully closed shield position, which is vertically pivoted to open or close a front opening of a main body of the helmet, formed in order to ensure a field of vision for a helmeted person, and that maintains the fully closed shield position by engaging a projection, which is formed either on a lower end portion of the shield or on the side of a helmet main body, which is opposite the lower end portion of the shield in the fully closed position, and a fitting portion formed on the other side, and that spreads the shield outward to disengage the projection from the fitting portion, is characterized in that:

the locking mechanism is so arranged that an operating element, which includes a sloping face portion, for releasing an engaged position of the fitting portion and the projection, and a pressing piece, for maintaining the engaged position, is located on a helmet main body side;

the operating element supports the sloping face portion that is rotated in directions where brought near and separated from the lower end portion of the shield, and in addition, supports the pressing piece so this can slide in directions where brought near and separated from the lower end portion of the shield;

through a transmission mechanism, which transmits, from the sloping face portion to the pressing piece, so that this slides in a direction in which the pressing piece is to be separated from the lower end portion of the shield, rotation of the sloping face portion in a direction where brought near the lower end portion of the shield, the sloping face portion is rotated in a direction wherein brought near the lower end portion of the shield;

then, the pressing piece is slid in a direction whereby separated from the lower end of the shield, and limitations restricting spreading of the shield are removed;

at the same time, as the sloping face portion is rotated in said direction, the sloping face portion is guided, from the lower end portion of the shield, and is inserted into the shield and the outer face of the helmet main body, so that the shield is spread outward, following the slope of the sloping face portion.

Furthermore, a locking mechanism, for a shield of a helmet, that maintains a fully closed shield position, which is vertically pivoted to open or close a front opening of a main body of the helmet, formed in order to ensure a field of vision for a helmeted person, and that maintains the fully closed shield position by engaging a projection, which is formed either on a lower end portion of the shield or on the side of a helmet main body, which is opposite the lower end portion of the shield in the fully closed position, and a fitting portion formed on the other side, and that spreads the shield outward to disengage the projection from the fitting portion, is characterized in that:

the locking mechanism is so arranged that an operating element, which includes a sloping face portion, for releasing an engaged position of the fitting portion and the projection, and a pressing piece, for maintaining the engaged position, is located on a helmet main body side;

by manipulating the operating element, the sloping face portion and the pressing piece are interlocked, and the pressing piece is separated from the lower end portion of the shield to remove limitations restricting spreading of the shield;

at the same time, as the sloping face portion is rotated in said direction, the sloping face portion is guided, from the lower end portion of the shield, and is inserted into the shield and the outer face of the helmet main body, so that the shield is spread outward, following the slope of the sloping face portion.

According to the present invention, after the fully closed shield position has been stably maintained, the operation for engaging and disengaging the projection from the fitting portion can be even further simplified.

Furthermore, in addition to the above described effects, the fully closed shield position can be more constantly maintained.

Further, since the size of the recessed space in the helmet main body for insertion of a finger to hook and unlock the shield can be minimized, a shock absorption space can be obtained, which also contributes to safety.

BRIEF DESCRIPTION OF THE DRAWINGS

FIG. 3B is a cross-sectional view taken along line (b)-(b) in FIG. 2A.

FIG. 4B is a cross-sectional view taken along line (b)-(b) in FIG. 2B.

DESCRIPTION OF THE PREFERRED EMBODIMENT(S)

The best modes for carrying out preparation of a shield locking mechanism for a helmet according to the present invention will now be described while referring to drawings.

Figure 3A:
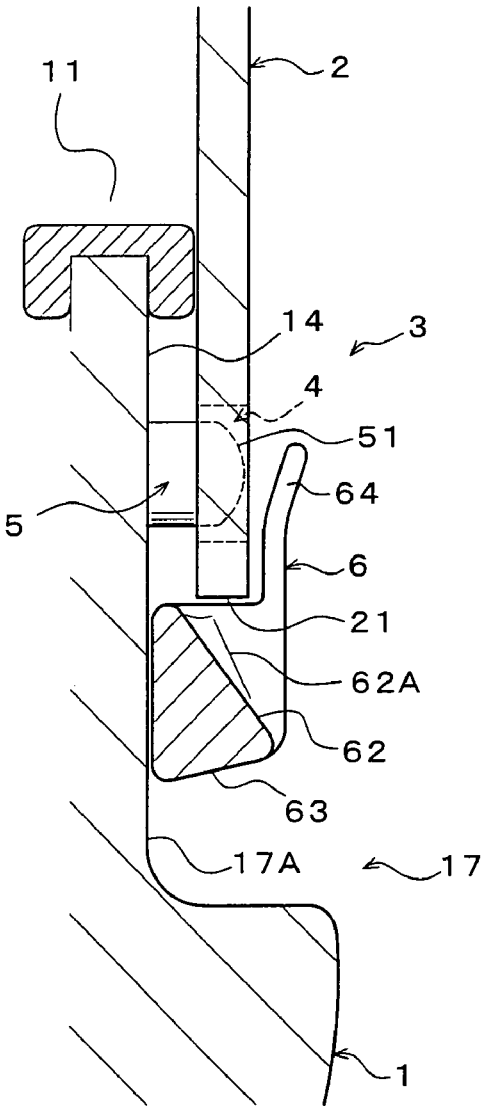
FIGS. 3A and 3B are two cross-sectional views taken along line (a)-(a) in FIG. 2A.
Figure 3B:
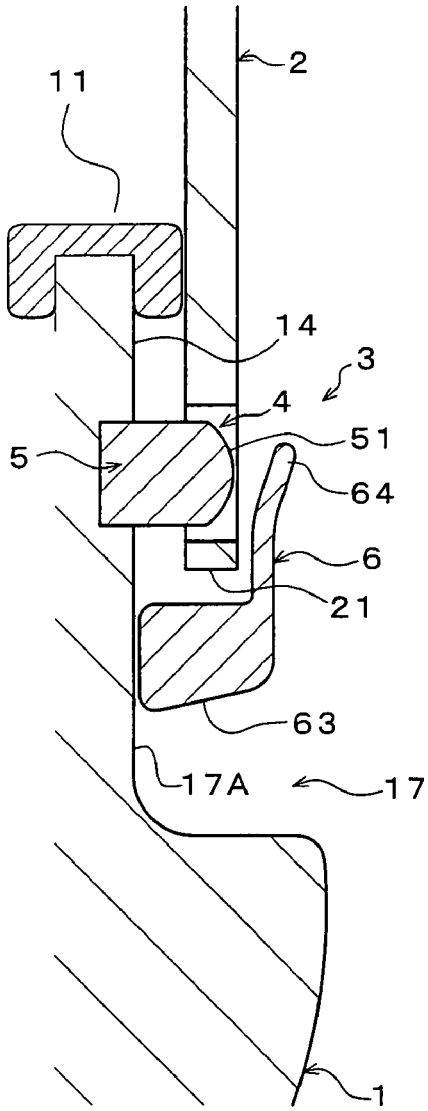
Figure 4A:
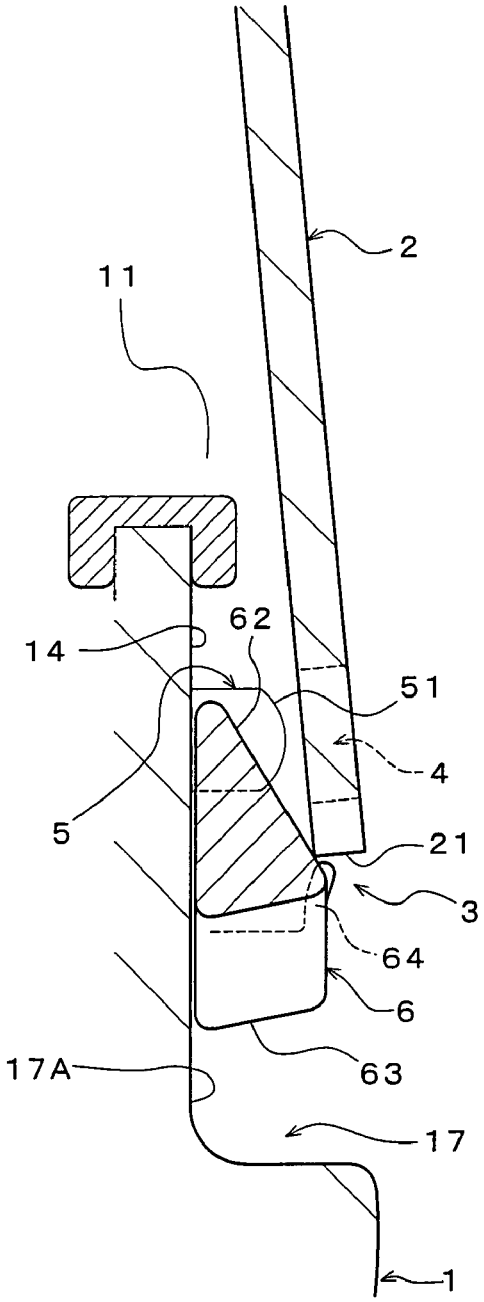
FIGS. 4A and 4B are two cross-sectional views taken along line (a)-(a) in FIG. 2B.
Figure 4B:
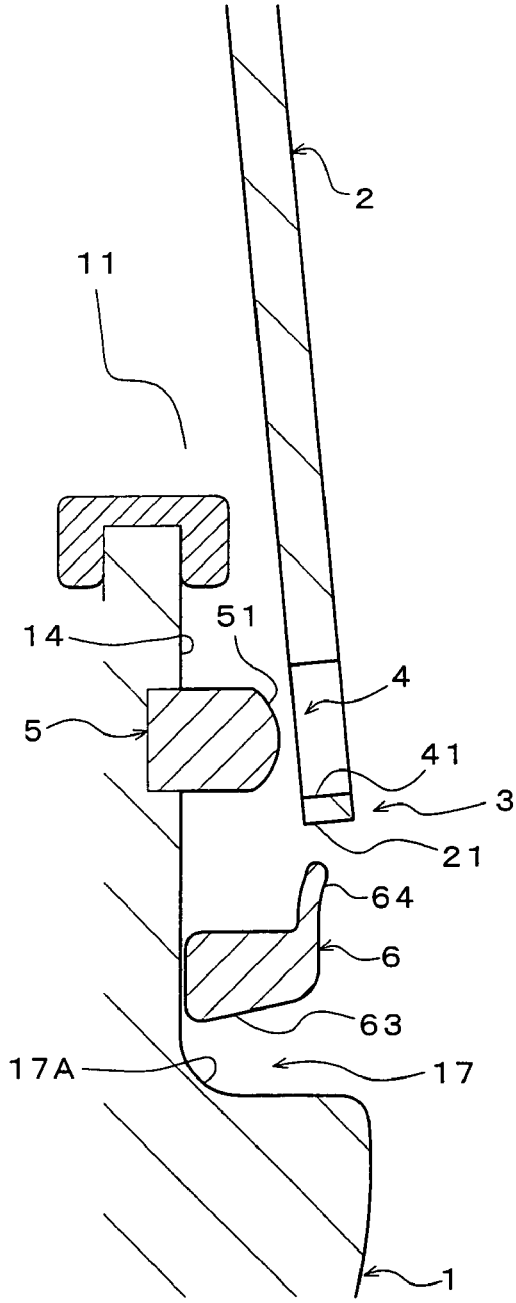
Figure 5A:
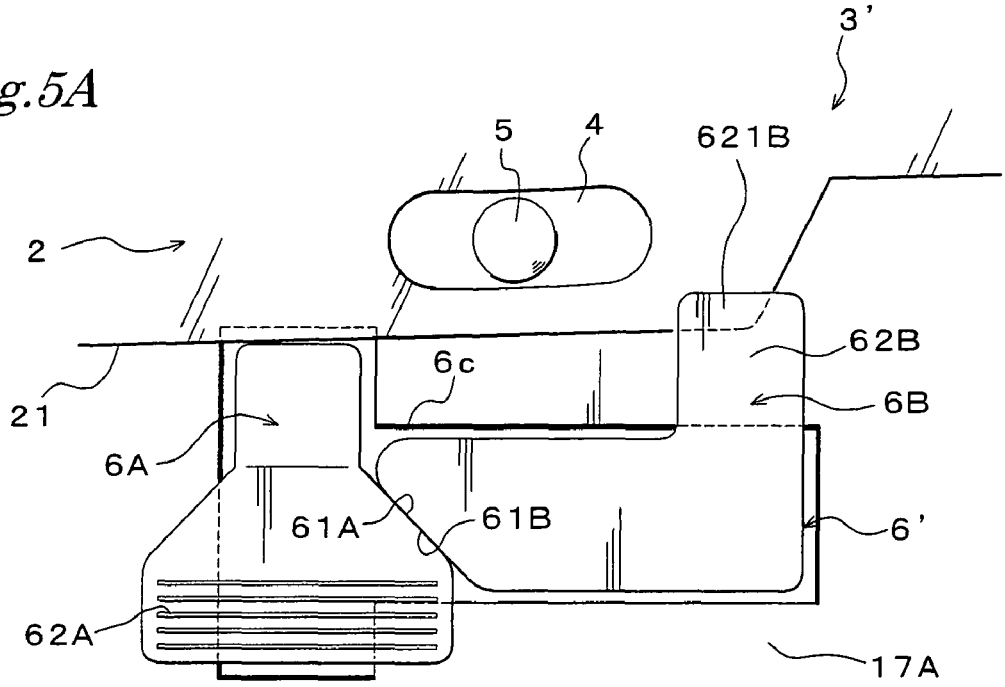
FIGS. 5A and 5B are two enlarged diagrams for the essential section of a locking mechanism for a second mode according to the present invention, FIG. 5A showing the fully closed position of a shield, and FIG. 5B showing the state indicating the opening movement of the shield.
Figure 5B:
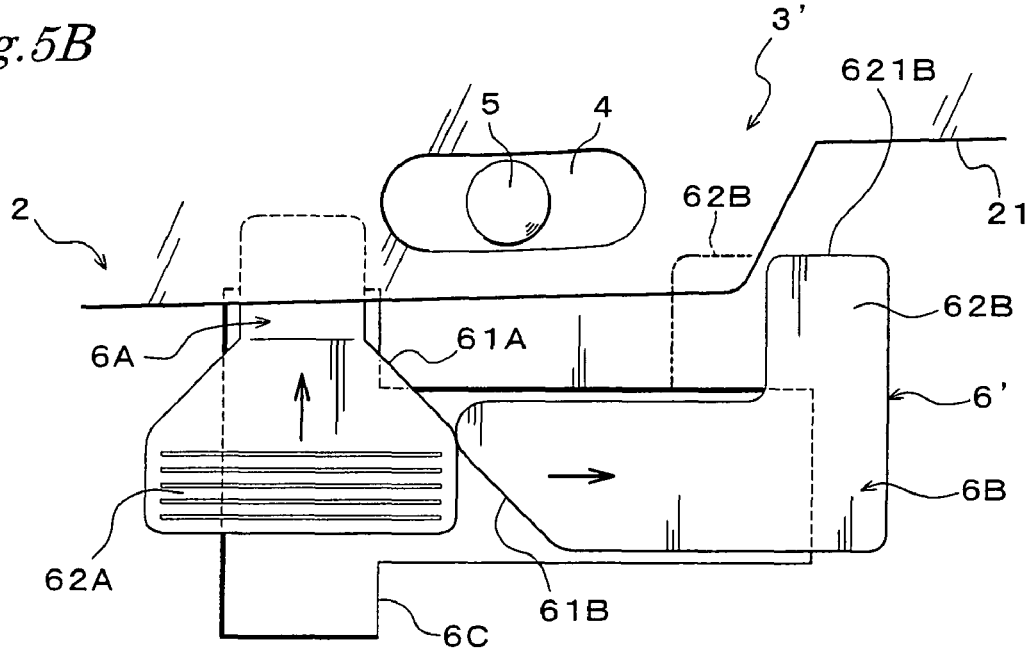
Figure 6:
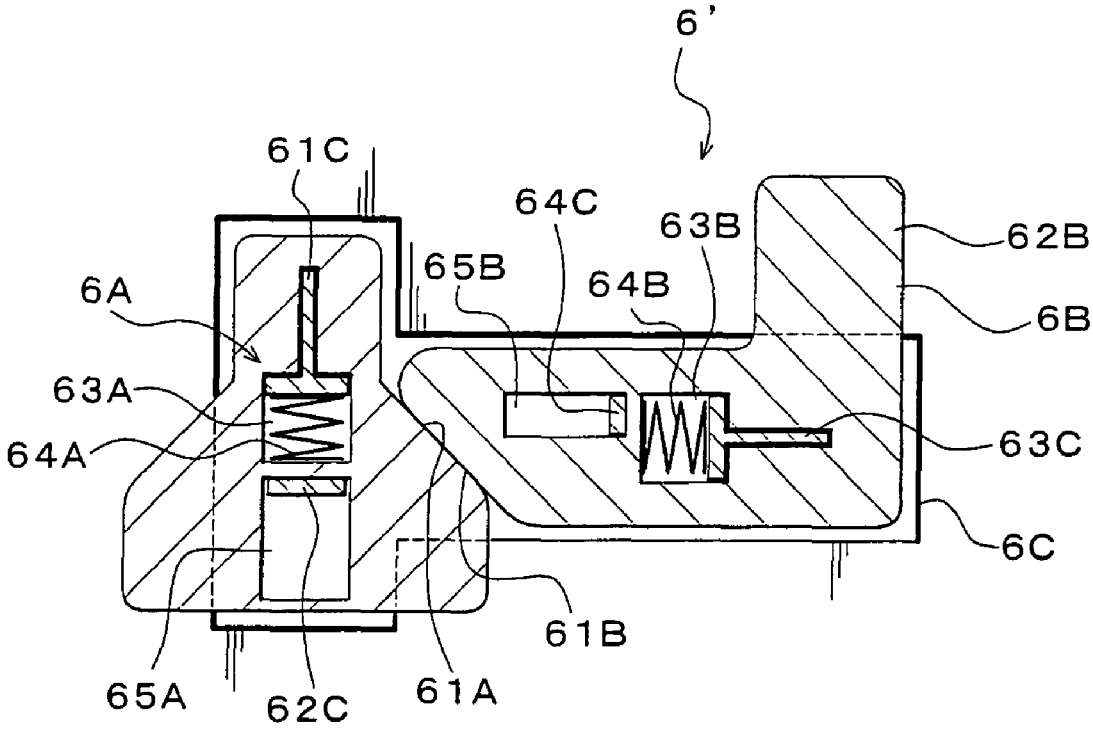
FIG. 6 shows a slide structure for the sloping face portion and the pressing piece of the locking mechanism shown in FIG. 5.
Figure 7A:
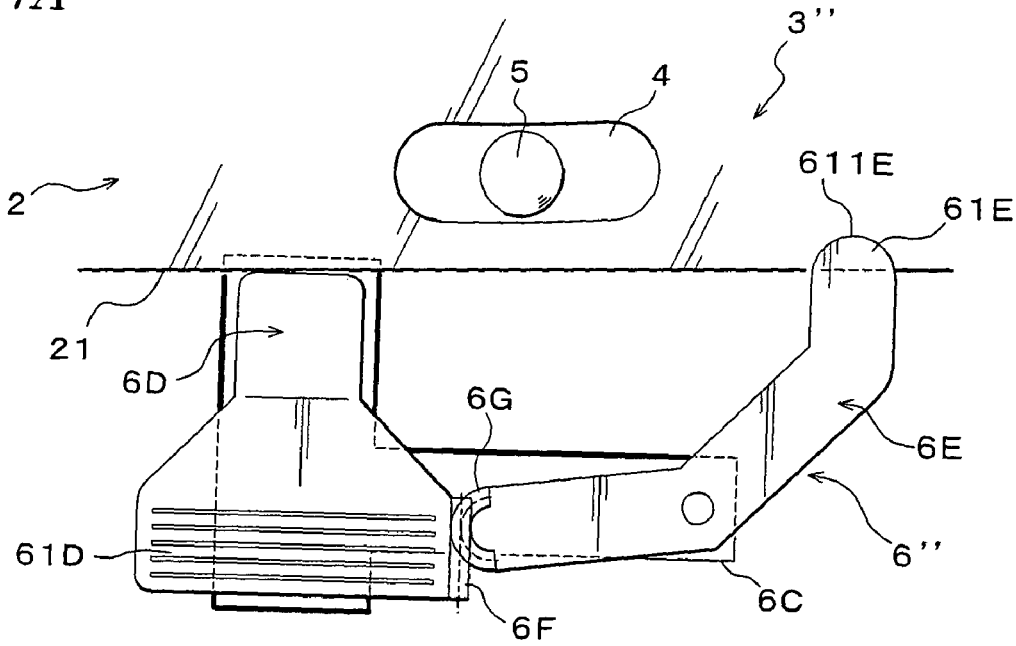
FIGS. 7A and 7B are two enlarged diagram of the essential section of a locking mechanism for a third mode according to the present invention, FIG. 7A showing the fully closed position of a shield, and FIG. 7B showing the state indicating the opening movement of the shield.
Figure 7B:
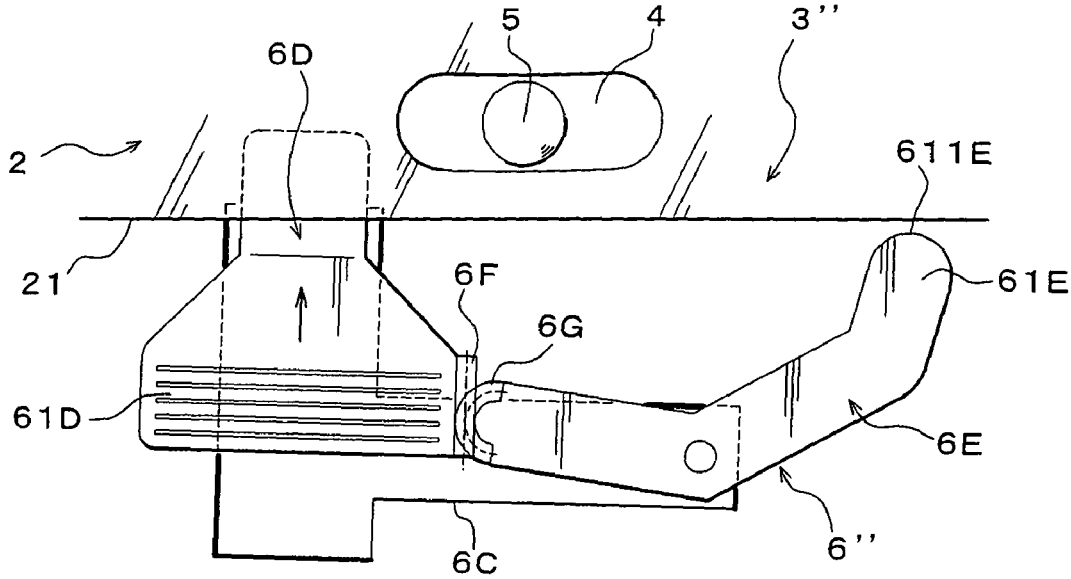
Figure 8A:
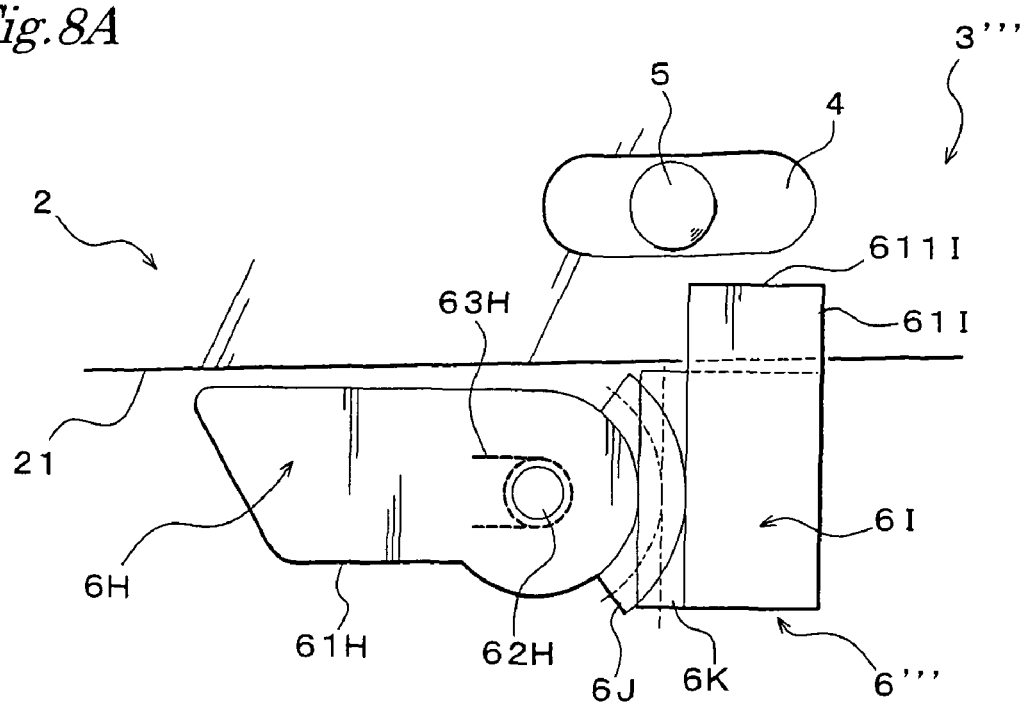
FIGS. 8A and 8B are two enlarged diagram for the essential section of a locking mechanism for a fourth mode according to the present invention, FIG. 8A showing the fully closed position of a shield, and FIG. 8B showing the state indicating the opening movement of the shield.
Figure 8B:
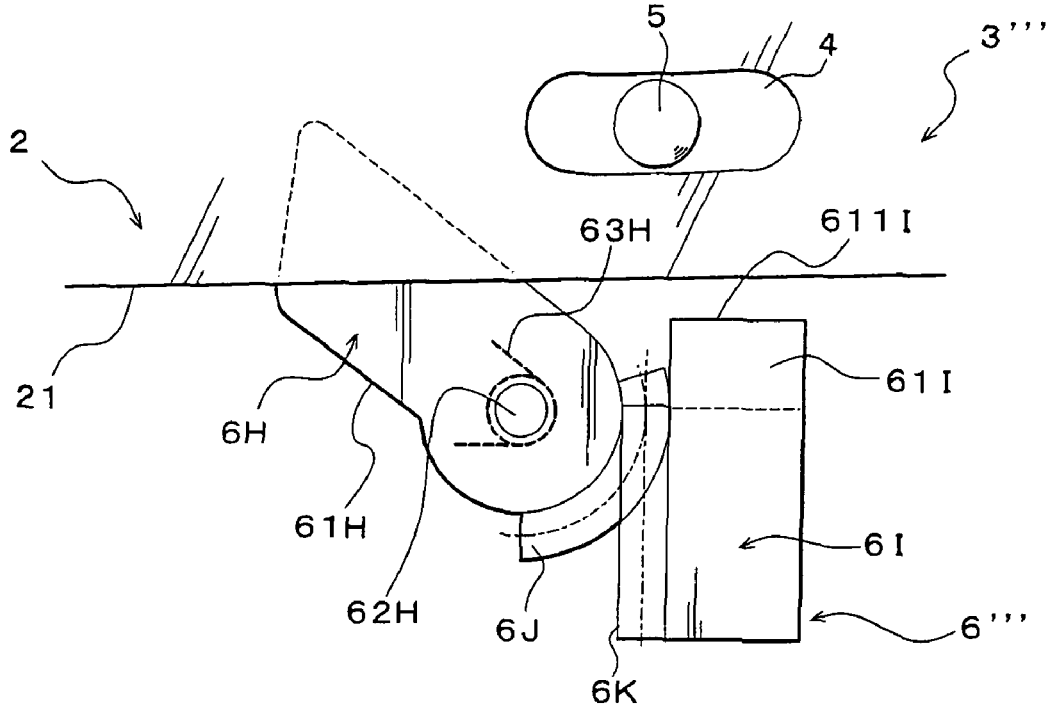

FIGS. 1 to 4 illustrate a first mode of the present invention, FIGS. 5 and 6 illustrate a second mode of the present invention, FIG. 7 illustrates a third mode of the present invention and FIG. 8 illustrates a fourth mode of the present invention.

It should be noted that an example helmet shown in the modes is a full face helmet; however, the present invention includes not only a full face helmet, but also a jet type helmet.

In the drawings, reference symbol A denotes a full face helmet; reference numeral 1 denotes a helmet main body; reference numeral 2 denotes a shield; reference numeral 3 denotes a locking mechanism; reference numeral 4 denotes a fitting portion; reference numeral 5 denotes a projection; and reference numeral 6 denotes an operating element.

It should be noted that the full face helmet A, shown as an example for this mode, is a well known helmet that includes: a helmet main body 1, wherein a shock absorption liner (not shown) is arranged on the inner wall of a cap member 12, which is the outermost layer in which a front opening 11 is formed in order to ensure an adequate field of vision for a helmeted person, and a head interior member (not shown), consonant with the head of a helmeted person, and cheek interior members (not shown), consonant with both cheeks of the person, are mounted inside the shock absorption liner; and a shield 2, which is supported at left and right side portions of the helmet main body 1 and pivots vertically, so that the opening 11 is opened and closed as the shield 2 is pivoted vertically.

Reference numeral 13 denotes a well known opening degree adjustment mechanism that can control the opening and closing of the shield 2, and can adjust the degree of the opening for the shield 2.

Reference numeral 14 denotes a stepped portion, which is formed in the area extending from a jaw guard portion 15 of the helmet main body 1 to a shaft portion 16 of the shield 2. The stepped portion 14 accepts the shield 2 in the fully closed position, so that the surface of the shield 2 and the surface of the helmet main body 1, from the jaw guard portion to the shaft portion 16, are substantially on the same plane.

Further, reference numeral 17 denotes a recessed space formed in order to support the operating element 6 and to permit a helmeted person to manipulate the operating element 6 by him- or herself. The space 17 is formed so that a support face 17A, where the operating element 6 is supported, is on the same plane as the surface of the step portion 14.

The locking mechanism 3 extends from the helmet main body 1 to the shield 2, on the left center of the full face helmet A in the diagram.

The locking mechanism 3 includes the fitting portion 4 on the shield 2 side, and the projection 5 and the operating element 6 on the helmet main body 1 side.

The fitting portion 4 is an elongated hole that is formed in the longitudinal direction of the shield 2 at a position that is near a lower end 21 of the shield 2 and is opposite the surface of the step portion 14 when the shield is fully closed.

The projection 5 is formed so that it fits into the fitting portion 4 when the shield 2 is fully closed.

In addition, the distal end of the projection 51 is provided as a spherical portion 51, having a spherical shape, and when the shield 2 and the fitting portion 4 cross the projection 5 during an operation for opening/closing the shield 2, the lower end 21 of the shield 2 and an edge 41 of the fitting portion 4 are guided across the spherical face of the spherical portion 51.

The operating element 6 is supported at the support face 17A of the space 17 and is rotatable perpendicular to the tangential line in the longitudinal direction of the shield 2.

For the operating element 6, a sloping face portion 62, which opens the shield 2 to the front and is used to disengage the projection 5 from the fitting portion 4, and a finger contact face portion 63, which a finger (not shown) of a helmeted person contacts to pivot the operating element 6 upward, are formed to the front of a shaft portion 61 that is employed as a rotation center. To the rear of the shaft portion 61, a pressing piece 64 is formed to prevent the shield 2 from spreading out in the fully closed position.

The sloping face portion 62 is sloped in a direction in which the thickness is increased from the upper end to the lower end, outward from the helmet main body 1. The upper end of the sloping face portion 62 is located below the lower end of the shield 2, and as the operating element 6 is rotated, the sloping face portion 62 is to be inserted between the shield 2, in the fully closed position, and the step portion 14, in the direction of the lower end 21 of the shield 2.

The finger contact face portion 63 is shaped with a flat face from the lower end of the sloping face portion 62 toward the step portion 14. When the finger contact portion 63 is pushed upward, the operating element 6 is rotated upward.

The pressing piece 64 is formed upright and is opposite the surface of the shield 2 in the fully closed position 2. In the fully closed shield position 2, the pressing piece 64 faces and is directly opposite the projection 5 and the fitting portion 4, so that the shield 2 is prevented from spreading outward and the engaged position of the projection 5 and the fitting portion 4 can be maintained.

The operation of the locking mechanism 3 of this mode for opening and closing the shield 2 will now be described.

Figure 1:
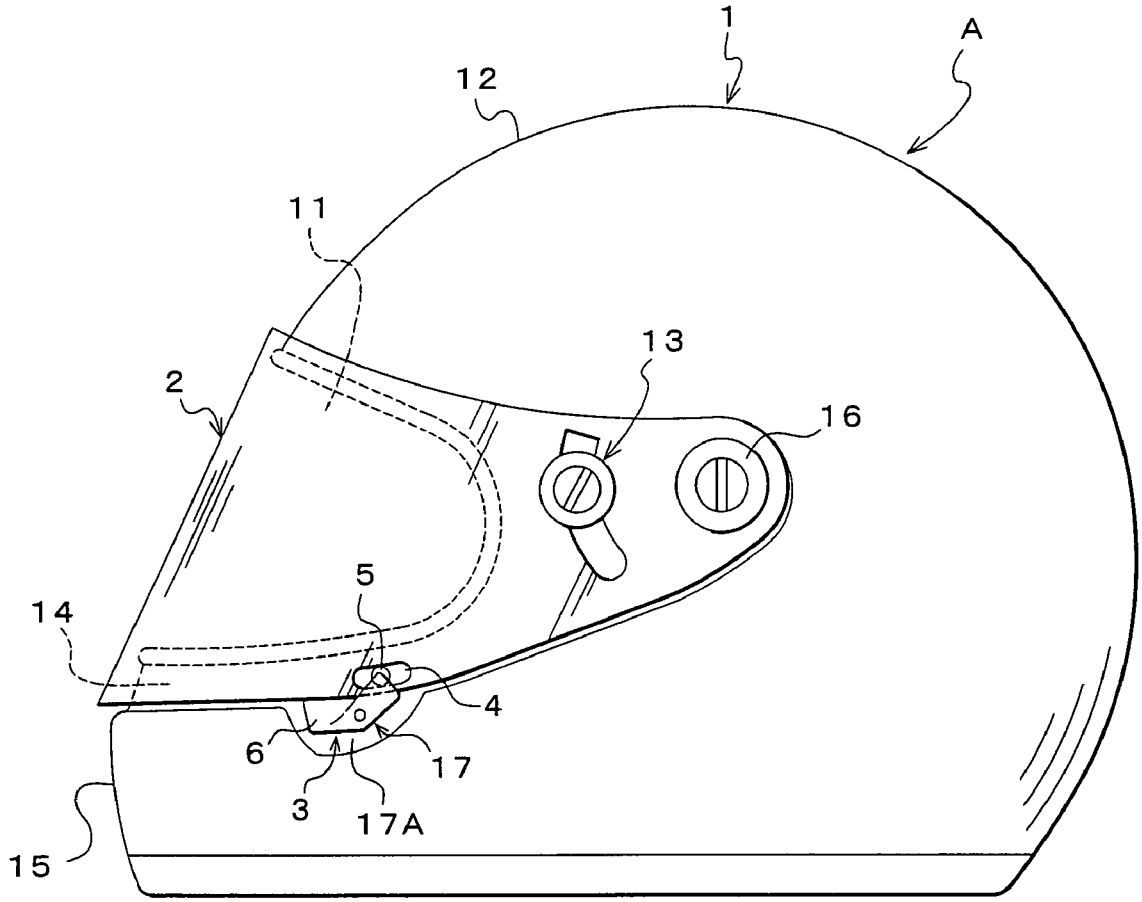
FIG. 1 is a side view of a full face helmet that carries out a locking mechanism for a first mode according to the present invention.
Figure 2A:
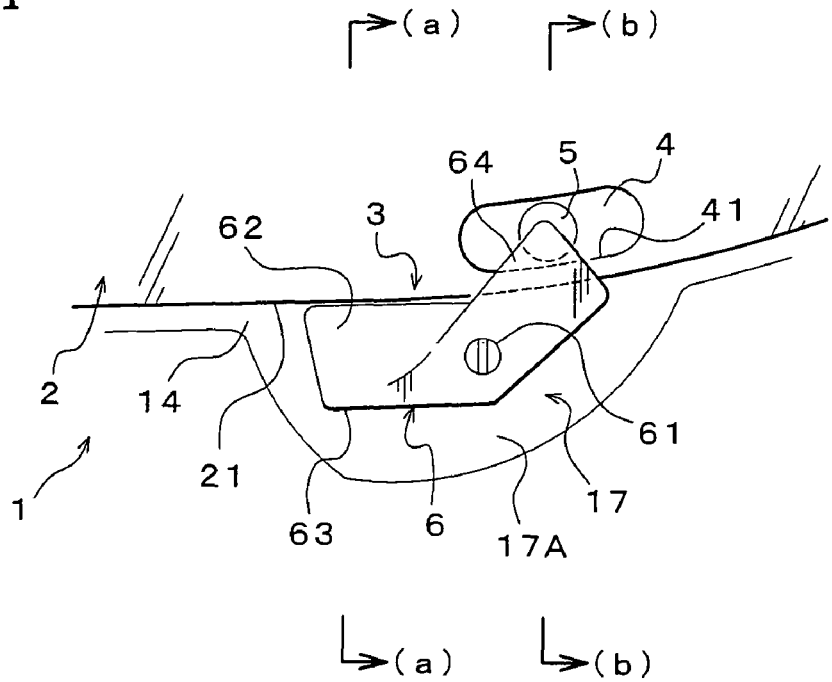
FIGS. 2A and 2B are two enlarged diagrams of the essential section in FIG. 1, FIG. 2A showing the fully closed position of a shield, and FIG. 2B showing the state indicating the opening movement of the shield.
Figure 2B:
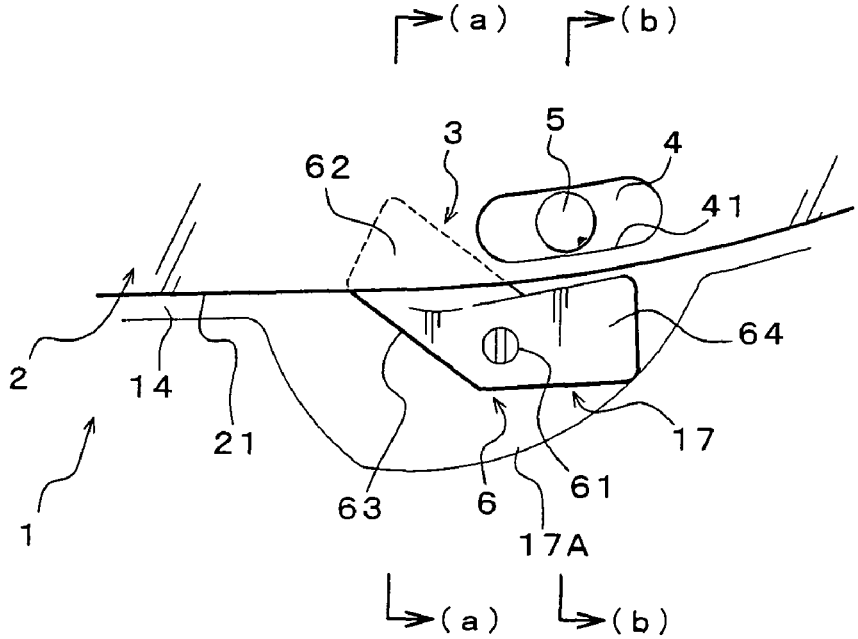

As shown in FIG. 2(*a*), FIG. 3(*a*) and FIG. 3(*b*), in the fully closed shield position 2, the projection 5 and the fitting portion 4 are in an engaged position, and the upper end of the sloping face portion 62 of the operating element 6 is located below the lower end 21 of the shield 2, while the pressing piece 64 is directly opposite the projection 5 and the fitting portion 4.

In the fully closed shield position 2, when the finger contact face portion 63 of the operating element 6 is pushed upward, as shown in FIG. 2(*b*), the sloping face portion 62 is pivoted upward at the shaft portion 61, while the pressing piece 64 is pivoted downward.

As shown in FIG. 4(*a*) and FIG. 4(*b*), the upper end of the sloping face portion 62 that is pivoted upward is inserted between the shield 2 and the step portion 14, in the direction of the lower end 21 of the shield 2. Further, in accordance with the continuous upward pivoting, the lower end 21 of the shield 2 is pushed upward, and the shield 2 is guided by the sloping face of the sloping face portion 62 in a direction in which it is spread out.

On the other hand, as shown in FIG. 2(*b*), FIG. 4(*a*) and FIG. 4(*b*), the pressing piece 64 that is pivoted downward is moved from the position where directly opposite the projection 5 and the fitting portion 5 is moved to a position, below the lower end 21 of the shield 2, at which no affect is provided for an operation during which the shield 2 is spread out by the sloping face portion 62.

When the shield 2 is spread out by the sloping face portion 62, and when the fitting portion 4 has reached the spherical portion 51 of the projection 5, through the upward driving force that is exerted on the shield 2, the edge 41 of the fitting portion 4 is guided along the spherical portion 51 and is moved upward and outward, so that the projection 5 is disengaged from the fitting portion 4.

In the position wherein the projection 5 is disengaged from the fitting portion 4, the sloping face portion 62 has been inserted between the shield 2 and the step portion 14, completely to the lower end, so that the position wherein the entire thickness of the lower end 21 of the shield 2 is located outside the sloping face portion 62, i.e., the position wherein the shield 2 is furthest spread, is obtained. And the finger of the helmeted person hooks the finger contact portion 63 and the lower end 21 of the shield 2.

And in the position in which the shield 2 is furthest spread, the pressing piece 64 is inhibited from being pivoted downward, while contacting the wall face portion 17B of the space at the lower end of the pressing piece 64, and the rotation of the operating element 6, related to the upward pivoting of the sloping face portion 62, is thereby regulated. However, since the direction of movement of the finger contact portion 63 is satisfactorily changed by rotation, substantially without any shifting of the finger, the helmeted person can pivot the shield 2 upward simply by hooking the lower end 21 of the shield 2, through continuous movements, and simply opening the shield 2.

The shield 2 need only be pushed down to change the shield 2 from the closed position to the open position. Regardless of where the operating element 6 is located within the rotation range, when the lower end 21 of the shield 2 contacts a step portion 62A of the sloping face portion 62, and when the spherical portion 51 of the projection 5 is reached by rotating the operating element 6 downward, through the downward pushing force that is exerted on the shield 2, the lower end 21 is guided along the spherical portion 51 and is moved downward and outward, so that the reverse face of the shield 2 proceeds until directly opposite the spherical portion 51.

And in this position, when the shield is rotated further downward, the shield 2 in the spread position is returned to the original shape, the fitting portion 4 and the projection 5 are engaged, and the shield 2 enters the fully closed position.

At this time, since the sloping face portion 62 of the operating element 6 is rotated downward by the lower end 21 of the shield 2 that is being rotated downward, the pressing piece 64 is rotated upward until directly opposite the projection 5 and the fitting portion 4, so that the position wherein the projection 5 and the fitting portion 4 are engaged is maintained.

According to the locking mechanism 3 of this mode, the opening operation for the shield 2 can be performed following the operation of the operating element 6 for engaging and disengaging from the fitting portion 4 and the projection 5.

Furthermore, in the fully closed shield position 2, in addition to maintaining the fully closed position provided by engaging the fitting portion 4 and the projection 5, the spreading out of the shield 2 is prevented by pressing piece 64 of the operating element to maintain the engagement of the fitting portion 4 and the projection 5.

Therefore, the fully closed shield position is steadily maintained, and the operation for engaging and disengaging from the fitting portion and the projection can be even further simplified.

That is, the locking mechanism 3 of this mode is characterized as follows. The locking mechanism 3 includes the operating element 6, for releasing from the engaged position and for maintaining the engaged position. The operating element 6 includes: the sloping face portion 62, which is inclined so as to facilitate insertion between the shield 2 and the step portion 14 (the outer wall portion) of the helmet main body 1 and to spread the shield 2 outward and disengage the projection 5 from the fitting portion 4; and the pressing piece 64, which is opposite the outer wall of the shield 2 in the fully closed position and prevents the shield 2 from spreading out.

The sloping face portion 62 and the pressing piece 64 are located on either side along the rotational center of the operating element 6, and are so supported they can be pivoted alternately in directions that bring them near and separate them from the lower end 21 of the shield 2.

And when the operating element 6 is pivoted in the direction in which the sloping face portion 62 is brought near the lower end 21 of the shield 2, the pressing piece 64 is rotated in a direction whereby separated from the lower end 21 of the shield 2 and whereby limitation are removed that restrict the spreading of the shield 2. At the same time, as the sloping face portion 62 is rotated in the pertinent direction, the sloping face portion 62 is inserted, from the lower end 21 side of the shield 2, between the shield 2 and the step portion 14 of the helmet main body 1, and spreads the shield 2 outward along the slope of the sloping face portion 62.

A second mode of the present invention will now be described while referring to FIGS. 5 and 6.

It should be noted that since a full face helmet shown as an example for this mode is the same as that shown as an example for the first mode, in this mode, an explanation will be given by illustrating only the essential portion of a shield locking mechanism.

A locking mechanism 3' for this mode comprises: the above described fitting portion 4 on the shield 2 side; and a projection 5 and an operating element 6' on the helmet main body 1 side.

It should be noted that since the structure of the fitting portion 4 and the projection 5, and the operating effects obtained are the same as those for the first mode, an explanation for them will not be given by providing the same reference numerals for these components.

The operating element 6' of this mode is formed of two independent members: a sloping face portion 6A, which is to be inserted between the shield 2 in the fully closed position and a step portion (not shown in this mode), in the direction of the lower end 21 of the shield 2, and spreads the shield 2 outward; and a pressing piece 6B, which is directly opposite the outer face of the shield 2 and prevents the shield 2 from spreading out.

The sloping face portion 6A of the mode is supported at the support face (not shown in this mode) of the space (not shown in this mode), so that the sloping face portion 6A is slidable in a direction where moved near (upward in the drawing), or apart from (downward in the drawing) the lower end 21 of the shield 2, and is to be constantly pushed in a direction in which moved apart from the lower end 21.

The pressing piece 6B in this mode is supported at the support face, so that the pressing piece 6B interacts with the sliding of the sloping face portion 6A, and that it is slidable in a direction in which moved near (upward in the drawing), or apart from (downward in the drawing) the lower end 21 of the shield 2, and is to be constantly pushed in a direction in which moved apart from the lower end 21.

And when the sloping face portion 6A is slid upward, the pressing piece 6B is to release pressing applied to the shield 2, and the sloping face portion 6A spreads the shield 2 outward, so as to disengage the projection 5 from the fitting portion 4.

The structure for the sloping face portion 6A and the pressing piece 6B will be specifically explained.

The sloping face portion 6A has an inclination such that the thickness is increased from the upper end to the lower end, toward the outer wall of the helmet main body.

Furthermore, a pushed, sloping face 61A, which inclines toward the pressing piece side, is formed on the lower side face of the sloping face portion 6A. And a finger contact face portion 62A is contiguously formed, downward from the terminal end of the pushed, sloping face 61A, so that a helmeted person can push with a finger to obtain an upward, sliding movement.

Further, as shown in FIG. 6, a sliding groove 63A is formed in the reverse face of the sloping face portion 6A so as to be slidably fitted over a sliding guide rail 61C, which is formed in a base plate 6C that is securely attached to the support face. A spring 64A is arranged from the slide groove 63A to the lower end of the slide guide rail 61C.

The spring 64A constantly urges the sloping face portion 6A in a direction in which it is slid downward. When the sloping face portion 6A is slid upward, the spring 64A is compressed, and the urging force is exerted upon the recovery of the compressed spring 64A in order to slide the sloping face portion 6A downward.

In addition, in the reverse face of the sloping face portion 6A, a second slide groove 65A is formed below the slide groove 63A, and is fitted over a slide guide projection 62C, which is formed on the base plate C.

A contact sloping face portion 61B, which is inclined in the same direction as the pushed, sloping face portion 61A, is formed at the distal end of the pressing piece 6B that is directly opposite the pushed, sloping face portion 61A. On the other hand, a pressing projection 62B, which presses against the outer wall of the shield 2, is projected upward from the rear end.

Further, as shown in FIG. 6, a slide groove 63B is formed in the reverse face of the pressing piece 6B, and is to be slidably fitted over a slide guide rail 63C that is formed in the base plate 6C. A spring 64B is arranged in the slide groove 63B and extends from the left edge of the slide groove 63B to the side edge of the slide guide rail 63C.

The spring 64B urges the pressing piece 6B constantly in a direction in which it slides toward the sloping face portion 6A, and holds the contact sloping face portion 61B in contact with the pushed, sloping face portion 61A.

And when the pushed, closed face portion 61A is moved upward in consonance with upward sliding of the sloping face portion 6A, because of the inclination relationship between the pushed, sloping face portion 61A and the contact sloping face portion 61B, the pressing piece 6B slides to the right, so that the pressing projection 62B reaches a not opposite position, outside the lower end 21 of the shield 2.

Furthermore, when the pressing piece 6B slides to the right, the spring 64B is compressed, and thus, the urging force exerted upon the recovery of the compressed spring 64B is employed to slide the pressing piece 6B to the left.

In addition, in the reverse face of the pressing piece 6B, a second slide groove 65B is formed to the left of the slide groove 63B, and is fitted over a slide groove 64C that is formed in the base plate 6C.

In an example for this mode wherein the pressing projection 62B of the shield 2 is located opposite and not opposite, a step portion is provided for the lower end 21 of the shield 2, so that the not opposite position is higher than the opposite position. When the pressing projection 62B is located at the not opposite position, the lower end 21 of the shield 2 is below an upper end 621B of the pressing projection 62B. When the pressing projection 62B is located at the not opposite position, the lower end 21 of the shield 2 is above the upper end 621B of the pressing projection 62B, so that when the shield 2 spreads out, the lower end 21 of the shield 2 passes above the upper end 621B of the pressing projection 62.

Moreover, the structure for the pushed, sloping face portion 61A and the contact sloping face portion 61B is a transmission mechanism that transmits, as a rightward sliding movement of the pressing piece 6B, the upward sliding of the sloping face portion 6A.

The operation of the locking mechanism 3' for this mode for opening and closing the shield 2 will now be described.

As shown in FIG. 5(*a*), in the fully closed shield position 2, the projection 5 and the fitting portion 4 are engaged, and the upper end of the sloping face portion 6A is located below the lower end of the shield 2, while the pressing piece 6B is opposite the outer wall of the shield 2.

In the fully closed shield position 2, when the finger contact face portion 62A of the sloping face portion 6A is pushed upward against the urging force of the spring 64A, because of the inclination relationship between the sloping face portion 61A and the contact sloping face portion 61A, the pressing piece 6B slides to the right, as shown in FIG. 5(*b*), and the upper end 621B of the pressing projection 62B moves to a position below the lower end 21 of the shield 2 so as not to prevent the shield 2 from spreading outward.

When the sloping face portion 6A slides upward, as shown in FIG. 4(*a*) and FIG. 4(*b*), its upper end is inserted between the shield 2, in the fully closed position, and the step portion, from the lower end 21 of the shield 2. As upward sliding is continued, the lower end 21 of the shield 2 is pushed upward, and urged by the sloping face of the sloping face portion 6A, the shield 2 is guided in a direction in which spread out.

Thereafter, through the same operation as in the example in the first mode performed for the shield 2, the projection 5 is disengaged from the fitting portion 4 and the shield 2 is pivoted upward by the finger of the helmeted person, so that the shield 2 can enter the open position.

In the open shield position 2, the finger of the helmeted person is removed from the sloping face portion 6A, and through the urging force of the spring 64A, the sloping face portion 6A is slid downward and is returned to the original position. In accordance with the return of the sloping face portion 6A, the pressing piece 6B is also slid to the left and is returned to the original position by the urging force of the spring 64B. Thus, when the shield 2 in the open position is pivoted downward and the projection 5 engages the fitting portion 4, the pressing piece 6B is located opposite the outer wall of the shield 2, and the position wherein the projection 5 engages the fitting portion 4 is obtained (not shown).

According to the locking mechanism 3' of this mode, the operation for opening the shield 2 can be performed following the operation of the operating element 6' for engaging and disengaging from the fitting portion 4 and the projection 5.

Further, in the fully closed shield position 2, not only is the fully closed position provided by engaging the fitting portion 4 and the projection 5 held, but also the spreading of the shield 2 is prevented by using the pressing piece 6B of the operating element 6' to maintain the engagement of the fitting portion 4 and the projection 5.

Therefore, the fully closed shield position is fully maintained, and the operation for engaging and disengaging of the fitting portion and the projection can be even further simplified.

That is, the locking mechanism 3' of this mode is characterized as follows. The locking mechanism 3' includes the operating element 6', for releasing the engaged position and for holding the engaged position. And the operating element 6' includes: the sloping face portion 6A, which is inclined so as to be inserted between the shield 2 and the step portion (the outer wall) of the helmet main body 1, from the lower end 21 of the shield 2, and to spread out the shield 2, so that the projection 5 can be disengaged from the fitting portion 4; and the pressing piece 6B, which is located opposite the outer wall of the shield 2 in the fully closed position in order to prevent the spreading of the shield 2.

The sloping face portion 6A and the pressing piece 6B are supported, so that they slide alternately in the directions to be moved near and apart from the lower end 21 of the shield 2, and that the pressing piece 6B interlocks with the sliding of the sloping face portion 6A in a direction to be moved near the lower end 21 of the shield 2, and slides from the position opposite the outer wall of the shield 2 to the not opposite position outside the lower end 21 of the shield 2.

And when the pushed, sloping face portion 6A is slid in a direction so as to be near the lower end 21 of the shield 2, the pressing piece 6B slides, through the pushed, sloping face portion 61A and the contact sloping face portion 61B, outside the position opposite the lower end 21 of the shield 2, and removes the pressing on the shield 2. At the same time, as the sloping face portion 6A is slid in the above described direction, the sloping face portion 6A is inserted, from the lower end 21 of the shield 2, between the shield 1 and the step portion of the helmet main body 1, and the shield 2 is spread out along the inclination of the sloping face portion 6A.

A third mode of the present invention will now be described while referring to FIG. 7.

It should be noted that since a full face helmet shown as an example for this mode is the same as that shown as an example for the first mode, in this mode, an explanation will be given by illustrating only the essential portion of a shield locking mechanism.

A locking mechanism 3''' for this mode comprises: the above described fitting portion 4 on the shield 2 side; and a projection 5 and an operating element 6" on the helmet main body 1 side.

It should be noted that since the structure of the fitting portion 4 and the projection 5 and the operation effects obtained are the same as those for the first mode, an explanation for them will not be given by providing the same reference numerals for these components.

The operating element 6" of this mode is formed of two independent members: a sloping face portion 6D, which is to be inserted between the shield 2 in the fully closed position and a step portion (not shown in this mode), in the direction of the lower end 21 of the shield 2, and spreads the shield 2 outward; and a pressing piece 6E, which is directly opposite the outer face of the shield 2 and prevents the shield 2 from spreading out.

The sloping face portion 6D of the mode is supported at the support face (not shown in this mode) of the space (not shown in this mode), so that the sloping face portion 6A is slidable in the direction to be moved near (upward in the drawing), or apart from (downward in the drawing) the lower end 21 of the shield 2, and is to be constantly pushed in a direction to be moved apart from the lower end 21.

The pressing piece 6E in this mode is supported at the support face, so that the pressing piece 6E interacts with the sliding of the sloping face portion 6D, and is rotatable in the direction to be moved near (upward in the drawing) or apart from (downward in the drawing) the sloping face portion.

And, when the sloping face portion 6D is slid upward, the pressing piece 6B is to release the pressing on the shield 2, and the sloping face portion 6D spreads the shield 2 outward so as to disengage the projection 5 from the fitting portion 4.

The structure for the sloping face portion 6D and the pressing piece 6E will be specifically explained.

The sloping face portion 6D has an inclination such that the thickness is increased from the upper end to the lower end toward the outer wall of the helmet main body.

Further, a finger contact portion 61D, which the finger of a helmeted person contacts, is formed at the lower portion of the sloping face portion 6D, and a gear shaped portion 6F is formed on the right side face of the finger contact face portion 61D and serves as part of a mechanism that changes the vertical sliding of the sloping face portion 6D to the rotation of the pressing piece 6E.

It should be noted that the sloping face portion D in this mode is attached so as to be vertically slidable by receiving an urging force from the structure shown in the second mode (not shown).

The pressing piece 6E is supported so as to be vertically rotatable, and a gear shaped portion 6G is formed at the distal end of the pressing piece 6E that is opposite the sloping face portion 6D. The gear shaped portion 6G serves as a part of the mechanism that changes the vertical sliding of the sloping face portion 6D into the rotation of the pressing piece 6E, and engages the gear shaped portion 6F.

On the other hand, a pressing projection 61E that holds the outer wall of the shield 2 is projected upward.

That is, when the gear shaped portion 6F is moved upward in accordance with the upward sliding of the sloping face portion 6D, because of the engagement of the gear shaped portion 6G and the gear shaped portion 6F, the pressing piece 6E is rotated in a direction in which the pressing projection 61E is moved downward. Thus, the pressing projection 61E reaches the not opposite position below the lower end 21 of the shield 2.

Further, for returning the pressing projection 61D of the pressing piece 6E to the position opposite the outer wall of the shield 2, when the finger of the helmeted person is removed from the sloping face portion 6D that was slid upward, the sloping face portion 6D is slid downward by the downward urging force.

And when the gear shaped portion 6F is moved downward as this sliding movement, because of the engagement of the gear shaped portion 6G and the gear shaped portion 6F, the pressing piece 6E is rotated in a process in which the pressing projection 61E is moved upward. Thus, the pressing projection 61E reaches the same position as the position opposite the outer wall of the shield 2.

The operation of the locking mechanism 3" for this mode for opening and closing the shield 2 will now be described.

As shown in FIG. 7(*a*), in the fully closed shield position 2, the projection 5 and the fitting portion 4 are engaged, and the upper end of the sloping face portion 6D is located below the lower end of the shield 2, while the pressing piece 6E is located opposite the outer wall of the shield 2.

In the fully closed shield position 2, when the finger contact face portion 61D of the sloping face portion 6A is pushed upward against the urging force, because of the engagement of the gear shaped portion 6F and the gear shaped portion 6G, the pressing piece 6E is rotated, during which the pressing projection 61E is moved downward, and the upper end 611E of the pressing projection 61E is moved to a position below the lower end 21 of the shield 2 so as not to prevent the shield 2 from spreading outward.

Through the same operation for the sloping face portion 6A in the second mode, the sloping face portion 6D, which slides upward, as shown in FIG. 7(*b*), guides the shield 2 in a direction so that it spreads out.

Thereafter, through the same operation as in the example in the first mode performed for the shield 2, the projection 5 is disengaged from the fitting portion 4, and the shield 2 is pivoted upward, by the finger of the helmeted person, so that the shield 2 can enter the open position.

In the open shield position 2, as in the second mode, the sloping face portion 6D is slid downward by the urging force, and is returned to the original position. Thus, in accordance with the return of the sloping face portion 6D, because of the engagement of the gear shaped portion 6F and the gear shaped portion 6G, the pressing piece 6E is rotated in a direction in which the pressing projection 61E is moved upward, and the pressing projection 61E reaches the same position as the position opposite the outer wall of the shield 2 (not shown).

According to the locking mechanism 3' of this mode, the operation for opening the shield 2 can be performed, following the operation of the operating element 6", for engaging and disengaging from the fitting portion 4 and the projection 5.

Further, in the fully closed shield position 2, not only is the fully closed position provided by engaging the fitting portion 4 and the projection 5 held, but also the spreading of the shield 2 is prevented by using the pressing piece 6E of the operating element 6' to maintain the engagement of the fitting portion 4 and the projection 5.

Therefore, the fully closed shield position is fully maintained, and the operation for the engaging and the disengaging from the fitting portion and the projection can be still further simplified.

That is, the locking mechanism 3" of this mode is characterized as follows. The locking mechanism 3" includes the operating element 6", for releasing the engaged position and for holding the engaged position. And the operating element 6" includes: the sloping face portion 6D, which is inclined so as to be inserted between the shield 2 and the step portion (outer wall) of the helmet main body 1, from the lower end 21 of the shield 2, and to spread out the shield 2, so that the projection 5 can be disengaged from the fitting portion 4; and the pressing piece 6E, which is located opposite the outer wall of the shield 2 in the fully closed position so as to prevent the spreading of the shield 2.

The sloping face portion 6D is supported, so that it slides alternately in the directions in which to be moved near and apart from the lower end 21 of the shield 2, while the pressing piece 6E is supported, so that it is rotated in directions to be moved near and apart from the lower end 21 of the shield 2. And a transmission mechanism (gear shaped portions 6F and 6G) is arranged so that, from the sloping face portion 6D and the pressing piece 6E, the sliding of the sloping face portion 6D in a direction for moving near the lower end 21 of the shield 2 is transmitted as the rotation of the pressing piece 6E in a direction for moving apart from the lower end 21 of the shield 2.

And when the sloping face portion 6D is slid in a direction so that it nears the lower end 21 of the shield 2, the pressing piece 6E is rotated in a direction where it is apart from the lower end 21 of the shield 2, and releases the pressing on the shield 2. At the same time, as the sloping face portion 6E is slid in the above described direction, the sloping face portion 6D is inserted, from the lower end 21 of the shield 2, between the shield 2 and the step portion of the helmet main body 1, and the shield 2 is spread out along the inclination of the sloping face portion 6D.

A fourth mode of the present invention will now be described while referring to FIG. 8.

It should be noted that, since a full face helmet shown as an example for this mode is the same as that shown as an example for the first mode, in this mode, an explanation will be given by illustrating only the essential portion of a shield locking mechanism.

A locking mechanism 3'" for this mode comprises: the above described fitting portion 4 on the shield 2 side; and a projection 5 and an operating element 6'" on the helmet main body 1 side.

It should be noted that since the structure of the fitting portion 4 and the projection 5 and the operating effects obtained are the same as those for the first mode, an explanation for them will not be given by providing the same reference numerals for these components.

The operating element 6''' of this mode is formed of two independent members: a sloping face portion 6H, which is to be inserted between the shield 2 in the fully closed position and a step portion (not shown in this mode), in a direction of the lower end 21 of the shield 2, and spreads the shield 2 outward; and a pressing piece 6I, which is directed opposite the outer face of the shield 2 and prevents the shield 2 from spreading out.

The sloping face portion 6H of the mode is supported at the support face (not shown in this mode) of the space (not shown in this mode), so that the sloping face portion 6A is slidable in a direction to be moved near (upward in the drawing), or apart from (downward in the drawing) the lower end 21 of the shield 2, and is to be constantly pushed in a direction to be moved apart from the lower end 21.

The pressing piece 6I in this mode is supported at the support face, so that the pressing piece 6E interacts with the rotation of the sloping face portion 6H, and so that it is slidable in a direction to be moved near (upward in the drawing), or apart from (downward in the drawing) the lower end 21 of the shield 2.

And, when the sloping face portion 6H is rotated upward, the pressing piece 6I is to release the pressing on the shield 2, and the sloping face portion 6H spreads the shield 2 outward so as to disengage the projection 5 from the fitting portion 4.

The structure for the sloping face portion 6H and the pressing piece 6I will be specifically explained.

The sloping face portion 6H is supported at the supported face so as to be perpendicularly rotatable relative to the tangential line in the longitudinal direction of the shield 2.

The sloping face portion 6H employs, as the rotary center, a shaft 62H that supports the sloping face portion 6H, and has an inclination such that the thickness is increased from the upper end to the lower end toward the outer wall of the helmet main body 1. On the lower end of the sloping face portion 6H, a finger contact face portion 61H is formed that the finger of a helmeted person contacts to rotate the sloping face portion 6H, and the upper end of the sloping face portion 6H is positioned below the lower end 21 of the shield 2.

And as the sloping face portion 6H is rotated, the sloping face portion 6H is to be inserted between the shield 2 in the fully closed position and a step portion (not shown in this mode), in the direction of the lower end 21 of the shield 2.

The finger contact face portion 61H is formed as a flat face, from the lower end of the sloping face portion 6H toward the step portion, and by pushing the finger face portion 61H upward, the sloping face portion 6H can be rotated upward.

Further, a coil spring 63H, which exerts a downward rotational force against the upward rotation of the sloping face portion 6H, is wound around the shaft 62H that supports the sloping face portion 6H. Since one end of the coil spring 63H is fixed to the sloping face portion 6H, and the other end is fixed to the support face, the urging force for providing downward rotation is exerted relative to the upward rotation of the sloping face portion 6H.

In addition, coaxially with the shaft 62H, a gear shaped portion 6J is provided on the right side face, in the drawing, of the shaft board portion of the sloping face portion 6H. The gear shaped portion 6J serves as part of a transmission mechanism that transmits, as the vertical sliding of the pressing piece 61, the vertical rotation of the sloping face portion 6H.

The pressing piece 6I is supported so as to be vertically slidable, and a gear shaped portion 6K is formed on the side face opposite the sloping face portion 6H to engage the gear shaped portion 6J. The gear shaped portion 6K serves as part of the transmission mechanism that transmits the vertical rotation of the sloping face portion 6H as the vertical sliding of the pressing piece 6I. On the upper end, a pressing projection 61I is projected upward to hold the outer wall of the shield 2.

It should be noted that the vertical sliding support structure of the pressing piece 6I can be provided by using, for example, the same structure as in the second mode, wherein the slide guide rail 61C on the support face side slidably engages the slide groove on the sloping face portion side (not shown).

That is, when the gear shaped portion 6J is moved upward in consonance with the rotation of the sloping face portion 6H in the same direction, because of the engagement of the gear shaped portion 6J and the gear shaped portion 6K, the pressing piece 61I is slid in a direction in which the pressing projection 61I is moved downward. Thus, the pressing projection 61I reaches the not opposite portion below the lower end 21 of the shield 2 (see (FIG. 8(*b*)).

Further, to return the pressing projection 61I of the pressing piece 6I to the position opposite the outer wall of the shield 2, when the finger of the helmeted person is removed from the sloping face portion 6H that was rotated upward, the sloping face portion 6H is rotated downward by the downward force that is exerted.

And as the gear shaped portion 6J is rotated downward in consonance with this rotation, because of the engagement of the gear shaped portion 6J and the gear shaped portion 6K, the pressing piece 6I is slid in a direction in which the pressing projection 61I is moved upward. Thus, the pressing projection 61I reaches the same position as the position opposite the outer wall of the shield 2.

The operation of the locking mechanism 3" for this mode for opening and closing the shield 2 will now be described.

As shown in FIG. 8(*a*), in the fully closed shield position 2, the projection 5 and the fitting portion 4 are engaged, and the upper end of the sloping face portion 6H is located below the lower end of the shield 2, while the pressing projection 61I of the pressing piece 6I is located opposite the outer wall of the shield 2.

In the fully closed shield position 2, when the finger contact face portion 61H of the sloping face portion 6H is rotated upward against the urging force, because of the engagement of the gear shaped portion 6J and the gear shaped portion 6K, the pressing piece 6I is slid in the direction in which the pressing projection 61I is moved downward, and the upper end 61I of the pressing projection 61I is moved to a position below the lower end 21 of the shield 2 in order not to prevent the shield 2 from spreading outward.

Through the same operation as for the sloping face portion 6 in the first mode, the sloping face portion 6H, which rotates upward, as shown in FIG. 8(*b*), guides the shield 2 in a direction in which spreading out is possible.

Thereafter, through the same operation as in the example in the first mode performed for the shield 2, the projection 5 is disengaged from the fitting portion 4, and the shield 2 is pivoted upward by the finger of the helmeted person, so that the shield 2 can enter the open position.

In the open shield position 2, as in the second mode, the sloping face portion 6H is rotated downward by the urging force and is returned to the original position. Thus, in accordance with the return of the sloping face portion 6H, because of the engagement of the gear shaped portion 6J and the gear shaped portion 6K, the pressing piece 6I is slid in a direction in which the pressing projection 61I is moved upward, and the pressing projection 61I reaches the same position as the position opposite the outer wall of the shield 2 (not shown).

According to the locking mechanism 3''' of this mode, the operation for opening the shield 2 can be performed following the operation of the operating element 6''' for engaging and disengaging from the fitting portion 4 and the projection 5.

Further, in the fully closed shield position 2, not only is the fully closed position provided by engaging the fitting portion 4 and the projection 5 held, but also the spreading of the shield 2 is prevented by using the pressing piece 6I of the operating element 6''' to maintain the engagement of the fitting portion 4 and the projection 5.

Therefore, the fully closed shield position is securely maintained, and the operation for engaging and disengaging from the fitting portion and the projection can be still further simplified.

That is, the locking mechanism 3''' of this mode is characterized as follows. The locking mechanism 3''' includes, on the helmet main body 1 side, the operating element 6''', for releasing the engaged position and for holding the engaged position of the fitting portion 4 and the projection 5. And the operating element 6''' supports the sloping face portion 6H, so that it rotates vertically while being moved near or apart from the lower end 21 of the shield 2, and supports the pressing piece 6I, so that it slides vertically as it is moved near and apart from the lower end of the shield 2. And a transmission mechanism (the gear shaped portions 6J and 6K) is extended from the sloping face portion 6H to the pressing piece 6I to transmit, as the downward sliding of the pressing piece 6I to be moved apart from the lower end 21 of the shield 2, the vertical rotation of the sloping face portion 6H to be moved near the lower end of the shield.

And when the sloping face portion 6H is rotated in a direction so as to come near the lower end 21 of the shield 2, the pressing piece 6I is slid in a direction in which apart from the lower end 21 of the shield 2, and releases the pressing on the shield 2. At the same time as the sloping face portion 6H is rotated in the above described direction, the sloping face portion 6H is inserted, from the lower end 21 of the shield 2, between the shield 2 and the step portion of the helmet main body 1, and the shield 2 is spread out along the inclination of the sloping face portion 6H.

It should be noted that the present invention is not limited to the modes illustrated as examples, and can be carried out by employing another arrangement without departing from the scope of the contents described in the individual claims of the invention.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A helmet having a main body which defines a front opening, a shield which is vertically pivotally connected to the main body to open or close the front opening, and a locking mechanism for the shield to maintain a fully closed shield position by engaging a projection which extends from a side of the helmet main body opposite a lower end portion of the shield in the fully closed position, and a fitting portion formed on said lower end portion of the shield, wherein said fitting portion comprises an elongated hole, the projection extending into and being engaged by the fitting portion when the shield is in the fully closed position over the front opening of the main body, the locking mechanism including an operating element having a sloping surface and a pressing piece, the locking mechanism being rotatably connected to a side of said main body for rotation from a locking position wherein the pressing piece is located on a side of said shield opposite the main body, such that the lower end portion of the shield is located between the main body and the pressing piece, with the pressing piece preventing bending of said shield away from said main body and disengagement of said projection from within said fitting portion and thus opening of said shield relative to said main body, to an unlocking position wherein the pressing piece is moved away from said shield, such that said portion of said shield is no longer located between the main body and the pressing piece, and the sloping face of the operating element is moved between said shield and said main body to bend said shield away from said main body to disengage said projection from within said fitting portion and thus enable the rotation of said shield to an opening position relative to said main body.

2. A helmet having a main body which defines a front opening, a shield which is vertically pivotally connected to the main body to open or close the front opening, and a locking mechanism on a side of the main body to maintain a fully closed shield position by engaging a projection which extends from a side of the helmet main body, which is opposite a lower end portion of the shield in the fully closed position, and a fitting portion formed on said lower end portion of the shield, wherein said fitting portion comprises an elongated hole another side, wherein:

the locking mechanism includes an operating element which includes a sloping face portion for releasing an engaged position of the fitting portion and the projection, and a pressing piece for maintaining the engaged position, the lower end portion of the shield being located between the main body and the pressing piece;

wherein the operating element supports the sloping face portion that is rotated in directions where brought near and separated from the lower end portion of the shield, and in addition, supports the pressing piece to enable sliding in directions where brought near and separated from the lower end portion of the shield;

through a transmission mechanism which transmits, from the sloping face portion to the pressing piece, so that this slides in a direction in which the pressing piece is to be separated from the lower end portion of the shield, rotation of the sloping face portion in a direction where brought near the lower end portion of the shield, the sloping face portion is rotated in a direction wherein brought near the lower end portion of the shield;

then, the pressing piece is slid in a direction whereby separated from the lower end of the shield, and limitations restricting spreading of the shield are removed;

at the same time, as the sloping face portion is rotated in said direction, the sloping face portion is guided, from the lower end portion of the shield, and is inserted into the shield and an outer face of the helmet main body, so that the shield is spread outward, following the slope of the sloping face portion.

3. A helmet having a main body which defines a front opening, a shield which is vertically pivotally connected to the main body to open or close the front opening, and a locking mechanism on a side of the main body to maintain a fully closed shield position by engaging a projection which extends from a side of the helmet main body which is opposite a lower end portion of the shield in the fully closed position, and a fitting portion formed on said lower end portion of the shield, wherein said fitting portion comprises an elongated hole, wherein:

the locking mechanism includes an operating element which includes a sloping face portion for releasing an engaged position of the fitting portion and the projection by spreading the shield outwardly, and a pressing piece for maintaining the engaged position, the lower end portion of the shield being located between the main body and the pressing piece;

wherein by rotating the operating element, the sloping face portion and the pressing piece are interlocked and the pressing piece is separated from the lower end portion of the shield to remove limitations restricting spreading of the shield, and as the operating element is rotated, the sloping face portion is inserted between the shield and an outer face of the helmet main body, so that the shield is spread outward, following the slope of the sloping face portion.

4. The helmet according to claim 1, wherein when in a locking position, the pressing piece is aligned with said projection.

* * * * *